United States Patent [19]

Louwenaar

[11] Patent Number: 4,497,145

[45] Date of Patent: Feb. 5, 1985

[54] SOLAR WARMING HUT

[76] Inventor: David W. Louwenaar, 1248 Ironton St., Aurora, Colo. 80010

[21] Appl. No.: 357,902

[22] Filed: Mar. 15, 1982

[51] Int. Cl.[3] ..... E04H 9/00; A61H 33/06

[52] U.S. Cl. ..... 52/1; 52/71; 52/204; 126/428; 126/452; 128/372

[58] Field of Search ..... 52/199, 262, 264, 173 R, 52/70, 71, 1, 204; 98/1.5; 236/92 C; 126/204, 417, 418, 426, 428, 430, 452; 128/372

[56] References Cited

U.S. PATENT DOCUMENTS

| | | | |
|---|---|---|---|
| 1,857,913 | 5/1932 | Judelson | 52/262 |
| 1,946,567 | 2/1934 | Braunworth | 128/372 |
| 2,234,515 | 3/1941 | Carrel et al. | 126/204 |
| 2,481,940 | 9/1949 | Moorhead | 236/92 C |
| 2,653,612 | 9/1953 | Hooe | 128/372 |
| 2,820,256 | 1/1958 | Dahl | 52/204 |
| 2,927,665 | 3/1960 | Hauf | 52/264 |
| 2,963,122 | 12/1960 | Jageman | 52/70 |
| 3,182,581 | 5/1965 | Von Poederoyen | 52/1 |
| 3,244,186 | 4/1966 | Thomason et al. | 126/428 |
| 3,252,258 | 5/1966 | Blickman et al. | 52/204 |
| 3,271,786 | 9/1966 | Joy | 128/372 |
| 3,323,438 | 6/1967 | Korff | 98/86 |
| 3,557,497 | 1/1971 | Schafer et al. | 52/1 |
| 3,610,249 | 10/1971 | Baker et al. | 128/372 |
| 3,640,034 | 2/1972 | Shotwell, Jr. | 52/70 |
| 3,918,221 | 11/1975 | Benjamin | 52/1 |
| 4,046,134 | 9/1977 | Scott | 52/1 |
| 4,242,846 | 1/1981 | Hurd et al. | 52/71 |
| 4,320,744 | 3/1982 | Fodor et al. | 126/417 |
| 4,381,632 | 5/1983 | Geitner | 52/264 |

*Primary Examiner*—John E. Murtagh
*Assistant Examiner*—Andrew Joseph Rudy
*Attorney, Agent, or Firm*—Jack C. Sloan

[57] ABSTRACT

A small portable enclosure has at least one windowlike surface for admitting the rays of the sun and an opaque interior to absorb the energy of those admitted sun rays, thereby raising the hut's interior temperature and consequently warming the hut's occupants. At least one safety vent is provided to control the hut's interior temperature and pressure.

6 Claims, 1 Drawing Figure

SOLAR WARMING HUT

BACKGROUND OF THE INVENTION

This invention generally relates to warming huts and more specifically relates to small, manually portable warming huts which may be used by those who have been exposed to prolonged cold weather conditions, i.e., workmen, cross country skiers, hunters, etc., and who therefore may be in temporary need of a heated enclosure. Such a hut may also be used as a warming area in or adjacent to an existing permanent dwelling which is being left in a colder condition in the interest of fuel economy.

Heretofore, warming huts have often comprised wooden cabins or shelters equipped with oil, gas or wood burning stoves as the source of heat. Typically these shelters are relatively large and are not "portable" in the manual sense. Consequently, shelters of this type are normally strategically placed for potential use rather than carried along with the outdoor undertaking. Furthermore, in addition to their size, weight and fuel supply problems, these shelters present certain hazards to their users, not the least of which are fire and carbon monoxide poisoning.

It is therefore a primary object of this invention to provide a warming hut which can be manually transported to areas where it may be needed and heated by solar energy so as to avoid the hazards normally associated with having stove devices inside relatively small enclosures. Another object of this invention is the use of the solar warming hut as an auxillary warming area for an existing dwelling. In this regard the warming hut can be used either inside or outside of the dwelling.

To these ends, this invention consists in the construction, combination and arrangement of those devices hereinafter more fully described and claimed. Reference is now made to the accompanying drawings and to the characters of reference thereon which form a part of this patent application.

BRIEF DESCRIPTION OF THE DRAWING

Referring now to FIG. 1, an enclosure 10 is constructed in a box like form having six enclosure forming surfaces consisting of four wall forming sides numbered 1, 2, 3 and 4, respectively. The floor is designated as 5 and the roof as 6. It will be appreciated that although FIG. 1 shows a substantially square box structure, many other configurations such as for example a hexagon with an accompanying hexagonal roof and floor, or an A-frame configuration having 5 enclosure forming surfaces, could be provided.

Figure 1:
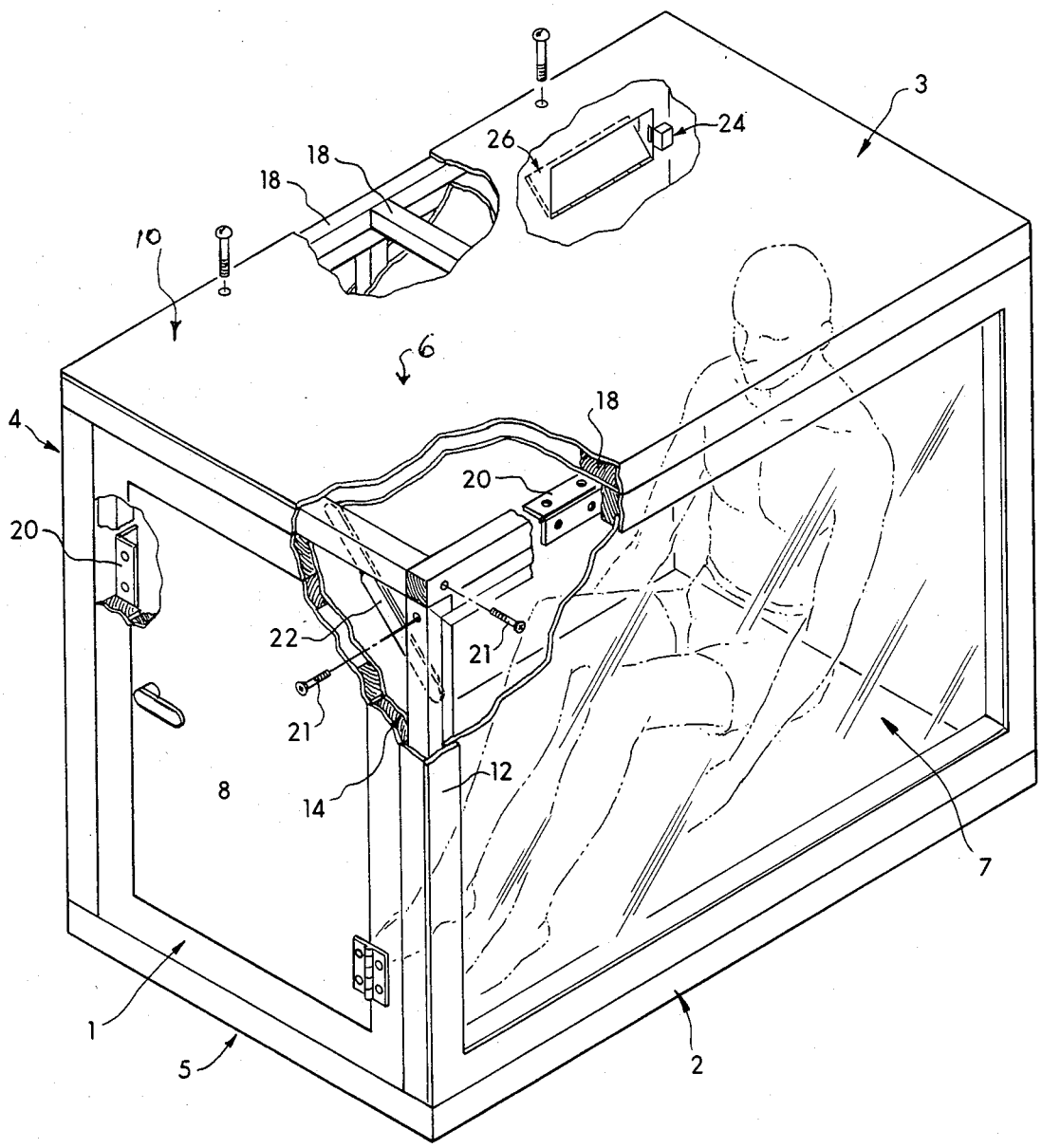
FIG. 1 is a perspective view of an occupied solar warming hut having hollow surfaces constructed with spacers between some flat rigid material such as plywood which forms an outside and an inside surface. Cut-away portions show the hollow features of the surfaces as well as certain details of construction such as the hinges which hold the surfaces together and the braces which hold the warming hut erect. One side of the hut is shown as a windowlike transparent covering. A temperature and pressure safety vent is also shown in the open position.

In any event the total surface area of the enclosure forming surfaces should be from about 100 to about 260 square feet. One or more of the enclosure forming surfaces should further comprise a transparent or translucent windowlike surface or surfaces 7. Preferably such a surface will comprise substantially all of one side such as side 2 of FIG. 1. Glass, plexiglas or clear plastic windows having from about 6 to about 100 square feet of surface area, are preferred. Normally one such light transmitting surface of about 20 square feet of surface area facing the sun will suffice to heat the solar warming hut to temperature in excess of 100° F. If additional heating capacity is desired, a plurality of light transmitting surfaces can be installed. Two adjacent sides i.e., 2 and 3, which can be simultaneously oriented in the direction of the sun, are the preferable window locations.

One of enclosure forming sides should be provided with an entrance such as the spring hinged door 8 shown in side 1. The warming hut is shown occupied by a human being and certain parts of the hut are shown in cut-away view to illustrate certain other features of construction hereinafter more fully described.

The sides of the warming hut 1, 2, 3, 4, 5 and 6 are shown in the cut away portions to be constructed of an outer layer 12 and an inner layer 14 separated by spacers 18. The spacers 18 are arranged to coincide with the edges of the sides. The sides can be constructed of a flat rigid material such as plywood. The spacers can be made of lengths of wood having, for example, two inch by two inch end dimensions and cut to the width of the sides as shown. Additional spacers 18 can be located every ten to sixteen inches. The spacers in effect provide an air space between the outer layer 12 and inner layer 14 which serves as an insulator.

The sides are detachably connected at their edges by suitable fastening means such as hinges, latches, interlocking edges, etc. Applicant prefers a construction utilizing double acting hinges 20 and lag bolts 21. The axis of the hinges 20 holding the vertical sides would be vertical while the axis of the hinges holding the roof and floor to the vertical sides would be horizontal. The right angle shape of the enclosure can be maintained by means of braces 22 which run diagonally between the roof and a vertical side or the floor and a vertical side as shown in FIG. 1. The braces are preferably of the collapsible type typically found on collapsible card tables. As a further aid in assembling the hut, the corners of the various sides can be color coded for quick indentification.

Taken together, the detachable hinged surfaces and collapsible braces provide the capability of readily collapsing and transporting or storing the hut in a compact form when it is not in use. When assembled by the use of these features, the hut will not have cold air drafts which would otherwise detract from its warming capabilities.

Regardless of the number of sides of the enclosure or the location and size of the transparent or translucent windows, it is of the utmost importance to this invention that a major portion of the inside surface of the nontransparent surfaces of the sides be of an opaque color such as black or dark blue. In an enclosure made of plywood this effect can be acheived by the application of a dark colored paint to these inside surfaces or, more preferably, by covering the inside surfaces with tarpaper. By this means the sunlight which enters the window will strike the opaque color and give up a portion of its energy in the form of heat to the interior of the hut.

Since the temperatures and pressures of the interior of the hut are capable of going rather high it is preferred that the hut be equipped with some temperature and/or pressure sensitive device 24 which can activate a safety vent 26.

While the vent system will normally be activated when the internal temperature and/or pressure reaches a level which is uncomfortable or unsafe for human beings, it should be appreciated that the temperature responsive device may be set at some other appropriate level if the hut is being used to warm animals or equipment.

Although I have shown and described a typical mode of construction, combination and arrangement of parts and portions of my solar warming hut, and a particular application regarding warming human beings, I do not wish to be limited to these particular construction combinations and arrangements, nor to the particular application, but rather desire to include with my invention those modifications which are included within the scope of the appended claims.

Having thus described my invention, I claim:

1. In a warming hut formed by detachably connected enclosure-forming surfaces, one of which has an entrance, wherein the improvement comprises:

six enclosure-forming surfaces detachably connected at their edges wherein at least five of the six enclosure-forming surfaces each have an outer plywood layer and an inner plywood layer separated by at least four wooden spacers arranged to coincide with the edges of the enclosure-forming surfaces which are constructed in a rectangular shape to form an air space between said outer plywood layer, said inner plywood layer and said spacers and wherein the enclosure-forming surfaces further comprise four vertical walls of equal height, a roof and a floor all of which have a total surface area of from about 100 square feet to about 260 square feet, and wherein a major portion of the inside surface of the inner plywood layers are further provided with an opaque coloring, and wherein at least one of the vertical walls is further provided with a window comprised of a sunlight transmitting surface having an area of from about six square feet to about 100 square feet, whereby a significant amount of sunlight passing through the window strikes the opaque coloring on the inside surface of the inner plywood layers and thereby gives up energy which raises warming hut's interior temperature.

2. The warming hut of claim 1 wherein the enclosure-forming surfaces are held in place by detachably connectable fastening means.

3. The warming hut of claim 1 wherein the enclosure-forming surfaces are held in place by means of vertical and horizontal hinge means mounted on edges of the enclosure-forming surfaces and by means of collapsible braces mounted diagonally between the enclosure forming surfaces.

4. The warming hut of claim 1 where one of the enclosure forming surfaces further comprises a spring hinged door.

5. The warming hut of claim 1 which further comprises a temperature sensitive device which can activate a safety vent.

6. The warming hut of claim 1 which further comprises a pressure sensitive device which can activate a safety vent.

* * * * *